United States Patent [19]

Austin

[11] 4,230,261

[45] Oct. 28, 1980

[54] LUNCH BOX CARTON AND A BLANK FOR FORMING SAME

[75] Inventor: John J. Austin, Hinsdale, Ill.

[73] Assignee: Champion International Corporation, Stamford, Conn.

[21] Appl. No.: 30,009

[22] Filed: Apr. 16, 1979

[51] Int. Cl.[3] ..... B65D 5/46; B65D 25/22

[52] U.S. Cl. ..... 229/52 B; 229/41 B; 229/39 R

[58] Field of Search ..... 229/41 B, 39 R, 38, 229/52 B, 44

[56] References Cited

U.S. PATENT DOCUMENTS

| | | | |
|---|---|---|---|
| 2,305,365 | 12/1942 | Wentz | 229/52 B X |
| 2,692,721 | 10/1954 | Pennebaker et al. | 229/45 |
| 2,838,222 | 6/1958 | Papadopoulos | 229/52 B X |
| 2,903,180 | 9/1959 | Holmes | 229/41 B X |
| 3,096,012 | 7/1963 | Bryant et al. | 229/52 B |
| 3,217,966 | 11/1965 | Kelly | 229/52 B X |
| 3,365,114 | 1/1968 | Macchi | 229/38 |

*Primary Examiner*—Davis T. Moorhead
*Attorney, Agent, or Firm*—Evelyn M. Sommer

[57] ABSTRACT

A lunch box carton made from a single cardboard blank with an attractive reclosable gabled top and an auto-erecting lock bottom. The lunch box carton has a tapered side wall construction, forming an inverted truncated pyramidal configuration to enable stacked nesting of a plurality of the cartons. The lunch box carton is of a knock-down variety which can be shipped in a flattened configuration and is further provided with an auto-erecting lock bottom to facilitate erection of the carton. The top portion of the carton is attractively gabled in configuration, providing additional interior volume, and includes integral carrying handles. Further, the carton is provided with movable wedge shaped locking portions pivotally connected on the top of the carton which can be interengaged with apertures provided in the side wall of the carton, to securely lock the carton in the closed condition. In addition, to prevent lateral shifting of the top of the carton, the carrying handles are secured by folding tabs.

16 Claims, 11 Drawing Figures

LUNCH BOX CARTON AND A BLANK FOR FORMING SAME

The subject invention relates to a new and improved lunch box carton and a blank for forming the same, with an attractive recloseable gabled top and an anto-erecting lock bottom. More particularly, the subject invention relates to a lunch box carton whose upper portion is closed by outwardly pushing two side panels of the top portion of the carton to form a wedge shaped locking configuration, thus causing the upper portions of the other opposed upper side panels to be drawn together forming a gabled configuration, whereupon the wedge shaped locking portions are inserted into generally triangular shaped openings cut into the side of the carton, resulting in an interengagement, thus sealing the carton.

The carton is intended to be used for storage and transportation of various items such as food or toys. To reduce shipping costs, it is a requirement that such cartons be shipped from the manufacturer in a flattened configuration. In applications where the carton is a take-out container for food, as for example in a fast food establishment, it is desirable that the carton be readily erected by the retailer, preferably during off-peak hours. Thus, it is also desirable, when many cartons are erected at one time, that the erected carton occupy as little space as possible.

Therefore, it is an object of the subject invention to provide a carton of the knockdown variety which can be shipped in a flattened configuration.

It is a further object of the subject invention to provide a carton which can be quickly and easily erected.

It is still a further object of the subject invention to provide a carton which can be stacked in a nested condition, after erection, prior to being used.

It is another object of the subject invention to provide a carton which is capable of being securely closed and easily reopened, and which includes an integral handle.

It is still a further object of the subject invention to provide a carton that is both attractive and aesthetically pleasing.

Further objects and advantages of the subject invention will become apparent from the following detailed description taken in conjunction with the drawings in which.

Figure 1:
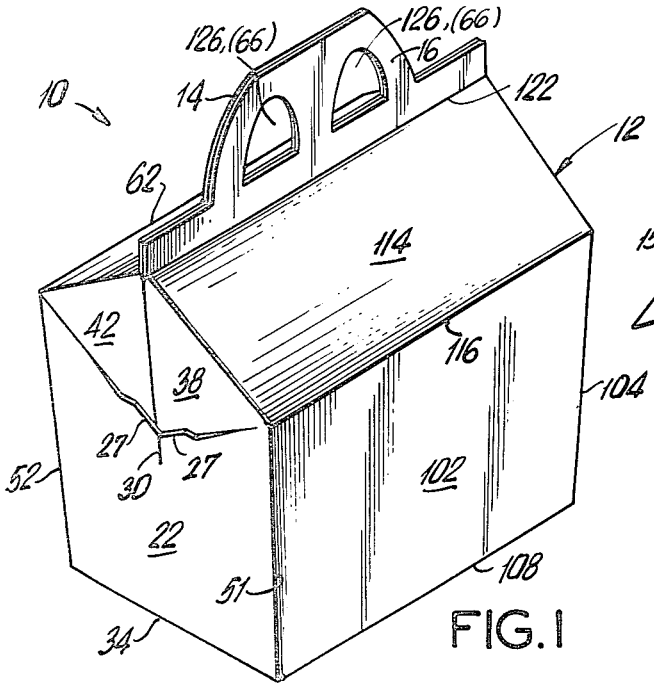
FIG. 1 is a perspective view of the closed carton of the subject invention.

Referring to FIG. 1, the lock bottom carton of the subject invention is designated generally by the numeral 10 and is intended for the storage and transportation of items, such as food or toys. The carton is generally rectangular in shape with the top portion 12 assuming a gabled configuration which, in addition to being attractive, provides extra interior volume for the closed carton. The latter is provided with matching handle tabs 14 and 16 for carrying the carton.

Figure 7:
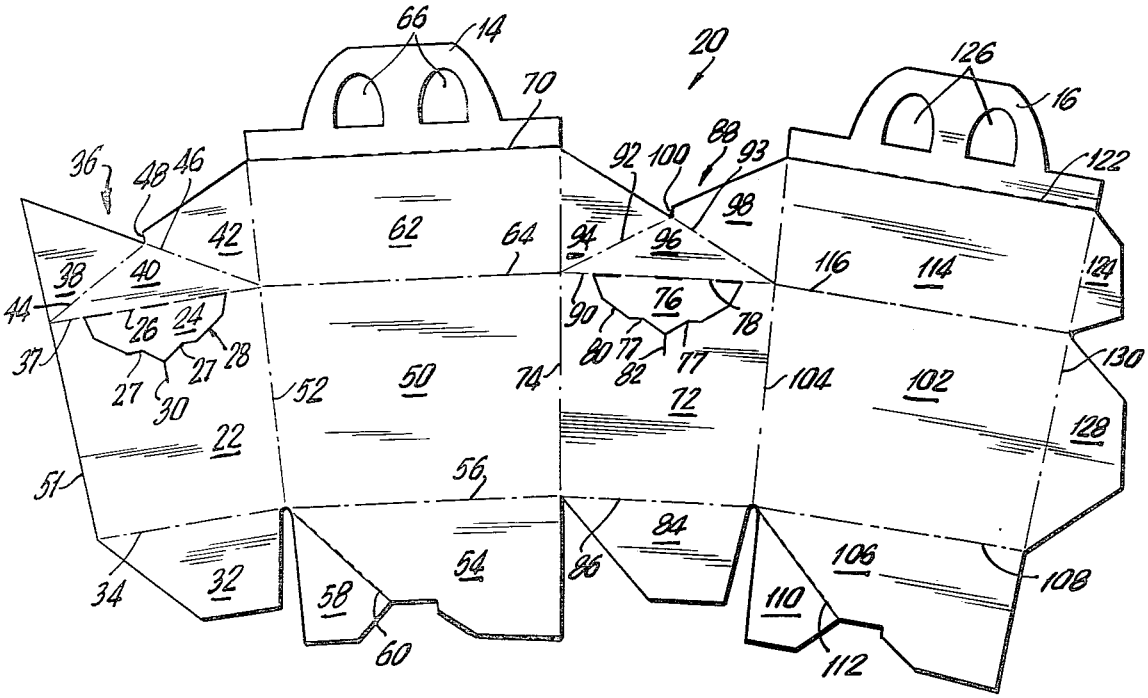
FIG. 7 is a plan view of the blank adapted to be folded into a lunch box carton of the subject invention.

FIG. 7 illustrates the blank 20 for forming the carton of the subject invention. Blank 20 includes a first locking side panel 22 having a pivot panel 24, of generally triangular configuration, which is pivotally connected thereto along hinge line 26. The remaining two sides of pivot panel 24 are defined by irregular cut line 28. The cut line 28 partially extends along the opposed ends of fold line 26 to facilitate the movement of the pivot panel 24. A cut or nick 30 is provided in the first locking side panel 22 directly below the pivot panel 24 to facilitate the insertion of a wedge shaped locking tab of the top panel into the locking side panel 22, as more fully described hereinafter. Cut line 28 defines two triangular projections 27 which are provided for effecting the interengagement of the wedge shaped locking tabs with the side panel 22 for locking of the carton in the closed configuration as shown in FIG. 1.

A first minor bottom panel 32 is hingedly connected along fold line 34 to the first locking side panel 22 while a first locking top panel 36 is hingedly connected along fold line 37 to the first locking side panel 22. The first locking top panel 36 includes a base triangular section 40 and two opposed equilateral support triangular sections 38, 42 which are hingedly connected to each other along fold lines 44 and 46, with their apexes meeting at a common point at the top center of locking top panel 36. Support triangle 42 has a flattened apex area 48 which in the wedge shaped configuration of top panel 36, will overlap the apex of the support triangle 38 in the closed carton, thereby affording greater structural rigidity to and securely closing the carton.

A first side panel 50 is hingedly connected along fold line 52 to the first locking side panel 22. A first major bottom panel 54 is hingedly connected along fold line 56 to the first side panel 50, and includes a first folding section 58 hingedly connected along fold line 60. When the carton is in the knockdown flattened configuration for shipping, the first folding section 58 is folded back into abutting relation with the first major bottom panel 54. A first top panel 62 is hingedly connected to both the first side panel 50 and the first locking top panel 36 along fold lines 64 and 52, respectively. A first handle tab 14 is hingedly connected along fold line 70 to the first top panel and includes two apertures 66, defining finger grips.

A second locking side panel 72 is hingedly connected along fold line 74 to the first side panel 50. The second locking side panel substantially corresponds to the configuration of the first locking side panel 22 and includes a pivot panel 76 pivotally connected thereto along hinge line 78, and further defined by cut line 80. Triangular projections 77 and nick 82 are similarly provided in side panel 72. A second minor bottom panel 84 is hingedly connected along fold line 86 and substantially corresponds to the configuration of the first minor bottom panel 32. A second locking top panel 88 is hingedly connected to the second locking side panel 72 and the first top panel 62 along fold lines 90, and 74, respectively. The second locking top panel 88 substantially corresponds to the configuration of the first locking top panel 36 and includes a base triangular section 96 and two opposed equilateral support triangular sections 94 and 98 hingedly connected along fold lines 92 and 93. Support triangle 98 is provided with a flattened apex portion 100.

A second side panel 102 is hingedly connected to the second locking side panel 72 along fold line 104 and substantially corresponds to the configuration of the first side panel 50. A second major bottom panel 106 is hingedly connected along fold line 108 to the second side panel 102 and substantially corresponds to the configuration of the first major bottom panel 54. The second major bottom panel 106 includes a second folding section 110 hingedly connected along fold line 112, while a second top panel 114 is hingedly connected to the second side panel 102 and the second locking panel 88 along fold lines 116 and 104, respectively. Panel 106 substantially corresponds to the configuration of the first top panel 62. A second handle tab 16 is hingedly connected along fold line 122 to the second top panel 114 and substantially corresponds to the configuration of the first handle tab 14, and includes two apertures 126 defining finger grips. A first glue tab 124 and a second glue tab 128 are respectively hingedly connected along fold line 130 to the second top panel 14 and the second side panel 102.

Figure 6:
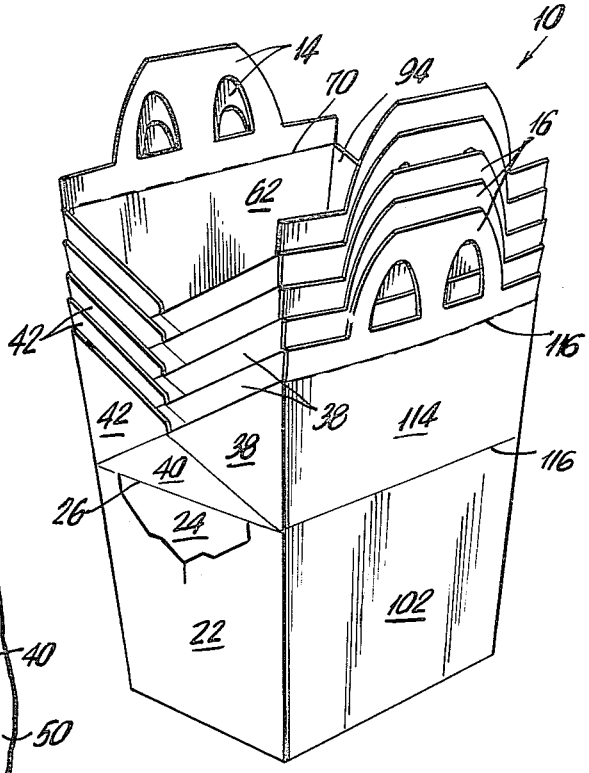
FIG. 6 is a perspective view of a plurality of cartons of the subject invention in a stacked arrangement.

To allow for nesting or stacking of the erected cartons, all the panels of the blank, except for the major and minor bottom panels (32, 54, 84 and 106) are tapered and are narrower near their bottom portions. This is accomplished by angling the vertical fold lines 51, 52, 74, 104, and 130 inwardly towards the bottom of the blank. The upper and lower edges of each of the panels are parallel to one another, for example, in first side panel 50 the fold lines 56 and 64 are parallel, while the vertical edges, 52 and 74 are tapered inwardly near the bottom of the panel. By this arrangement, the erected cartons can be nested or stacked within each other, as illustrated in FIG. 6.

The subject carton is intended to be glued and folded into a flattened configuration by the carton manufacturer. This configuration allows for reduced shipping costs. The bottom panels 32, 54, 84, and 106 are folded upwardly along their respective fold lines. The first and second folding sections 58 and 110 are folded back into abutting relation with the major bottom panels 54 and 106. Then the first locking side panel 22 and the second side panel 102 are folded inwardly along the fold lines 52 and 104, respectively, forming the flattened configuration. Then the inner surface of each folding section 58 and 110 is adhesively joined with the outer surface of minor bottom panels 32 and 84 respectively. The first and second glue tabs 124 and 128 are adhesively joined with the inner surfaces of the first locking top panel 36 and the first locking side panel 22 respectively.

Figure 8:
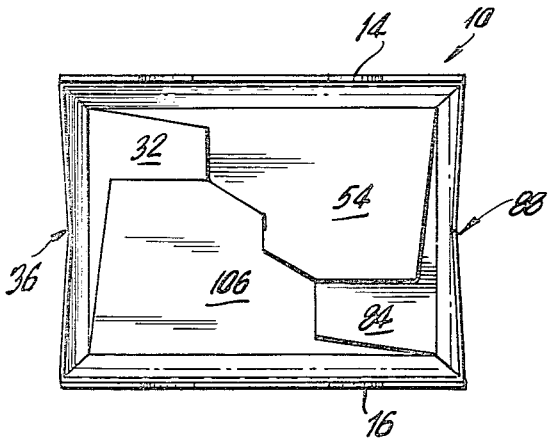
FIG. 8 is an internal plan view of the base of the subject carton illustrating the interengagement of the bottom panels.

When a carton reaches the retailer, it is erected simply by expanding the flattened configuration, by separating fold lines 74 and 130 from their abutting relation, forming a rectangular configuration such that the locking side panels 22 and 72 are parallel to each other and in an orthogonal relationship to the side panels 50 and 102. This results in the automatic erection of the lock bottom, which in turn prevents the carton from collapsing (see FIG. 8). The bottom panels are securely interengaged and the carton can be collapsed only by pushing inwardly at the center of the bottom of the carton thereby releasing the interengagement of the bottom panels.

Many cartons 10 may be readily erected in a short period of time. Since the side panels are tapered towards the bottom of the carton, creating a truncated inverted pyramidal configuration, the erected cartons can be stacked or nested, as illustrated in FIG. 6, and thus readily accessible as required.

Figure 9:
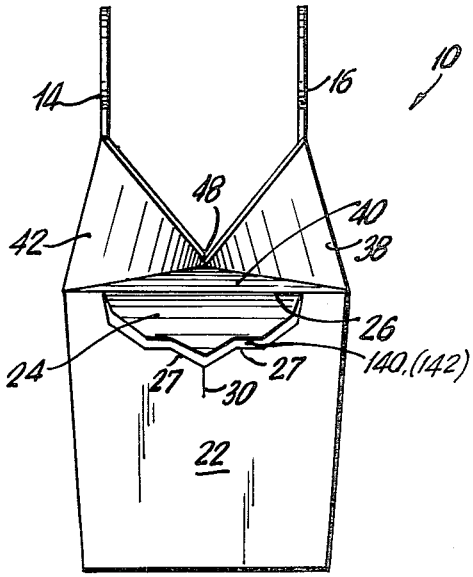
FIG. 9 is a side elevational view of the carton of the subject invention illustrating the top portion in a partial closure position.

After a carton 10 has been filled, it is easily closed. The locking top panels 36 and 88 are pushed outwardly (see FIGS. 2 and 9) at the top of the center of the panels 36 and 88 which results in the upper portions of the top panels 62, and 114 being drawn together to form an attractive gabled configuration. The movement of the locking top panels 36 and 88 caused the pivot panels 24 and 76 to swing inwardly into the carton creating generally triangular shaped openings 140 and 142 (See FIG. 9). Assuming the carton is not so completely packed so as to hinder the movement of said pivot panels, the latter will rotate around the hinged axes 37 and 80 to a maximum of 180°. However, it is only necessary that a slight displacement of approximately 5°, relative to the plane of the associated locking side panel 22 and 72 take place to afford adequate clearance for insertion of the end portions of the wedge shaped locking tabs into the triangular shaped openings 140 and 142. Thus, even if the carton is fully packed, an interengagement can still be obtained.

Figure 2:
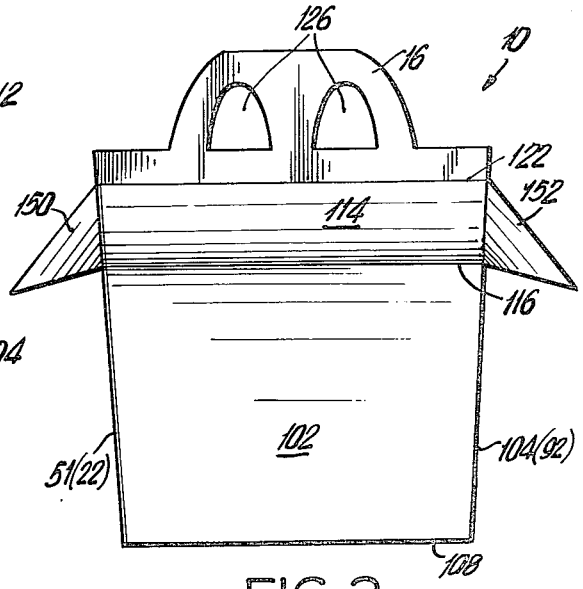
FIG. 2 is a front elevational view of the carton of the subject invention illustrating partial closure of the top portion.
Figure 3:
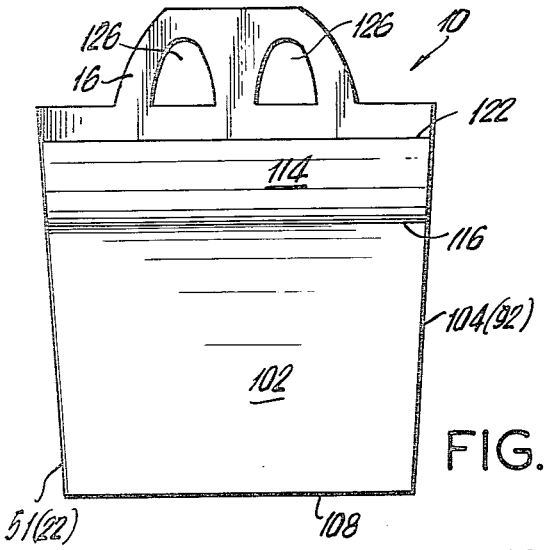
FIG. 3 is a front elevational view of the subject carton with the top portion closed.
Figure 5:
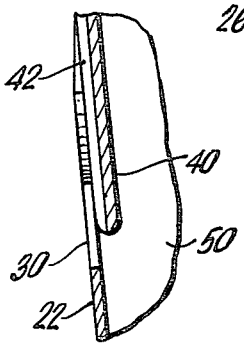
FIG. 5 is a cross-sectional view taken along line 5—5 in FIG. 4.

Continued rotation of the locking top panels 36 and 88 around the hinged axes 26 and 78 causes the support triangular sections 38, 42 and 94, 98 of the panel to overlap the associated base triangles 40 and 96 forming wedge shaped tabs 150 and 152, illustrated in FIG. 2. The flattened apex portion 48 and 100 of the triangular sections 36 and 88 respectively, additionally overlap the triangular sections 38 and 94, creating a triple ply of paperboard at the end points of the wedge shaped tabs 150 and 152 (see FIG. 5). This overlapping functions to increase the structural rigidity of the locking mechanism and insures a secure closure of the carton.

Figure 4:
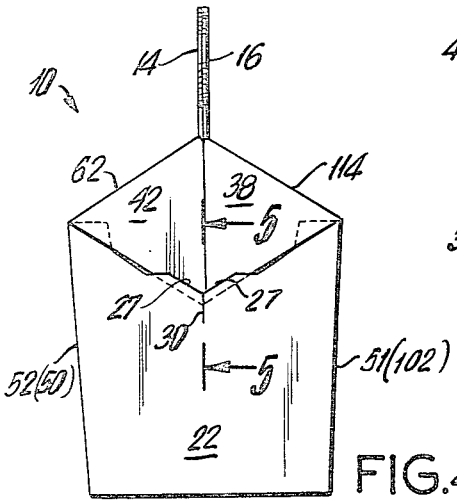
FIG. 4 is a side elevational view, illustrating the interengagement between a wedge shaped locking tab and the generally triangular cut-out in the side panel.

The wedge shaped tabs 150 and 152 have a cross section greater than the cross-section of the triangular shaped openings 140 and 142. The nicks 70 and 82 are provided to permit a temporary enlargement of the openings 140 and 142 allowing a portion of the wedge shaped tabs 150 and 152 to be inserted therein. Once the wedge shaped tabs 150 and 152 are inserted, they are held in place by the angled projections 27 and 77 respectively. (See FIGS. 4 and 5).

As illustrated in FIG. 1, the handle tabs 14 and 16 are drawn together in an aligned and abutting relation, with the apertures 66 and 126 being in register and forming finger grips allowing the carton to be easily carried.

When it is necessary for the carton to be reopened, to obtain the contents therein, the wedge shaped tabs 150 and 152 are manually popped out of the triangular openings 140 and 142, and the top sides of the carton are readily separated, exposing all of the graphics on the carton. The subject carton is capable of being repeatedly reclosed and reopened.

Figure 10:
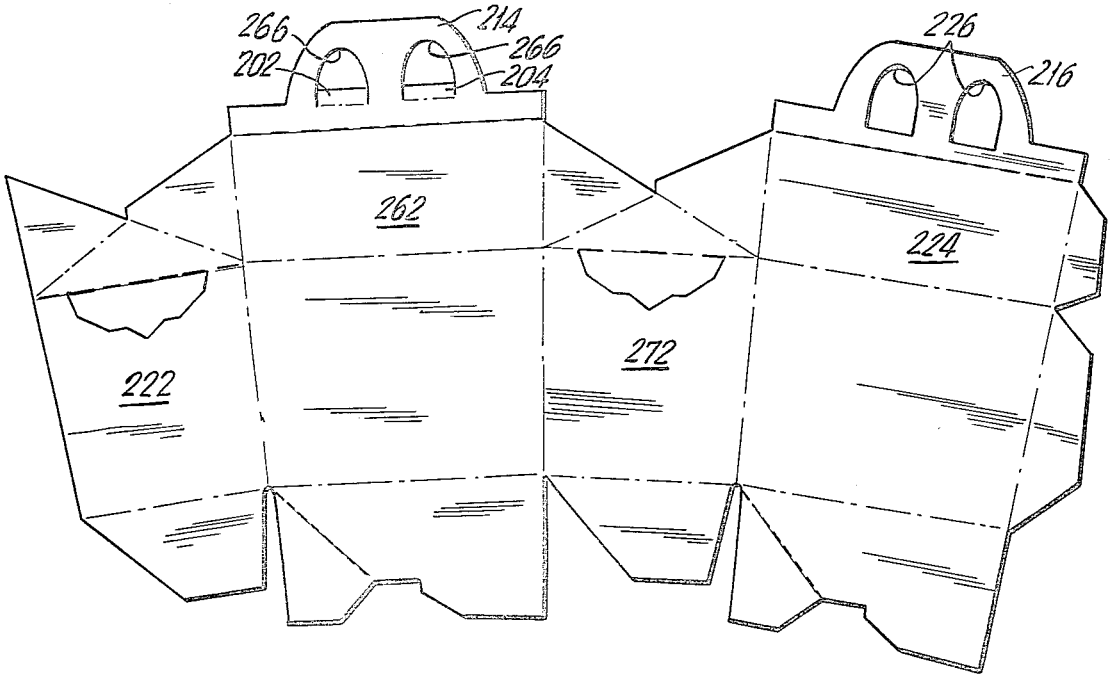
FIG. 10 is a plan view, similar to FIG. 7, of a second embodiment of the subject invention.
Figure 11:
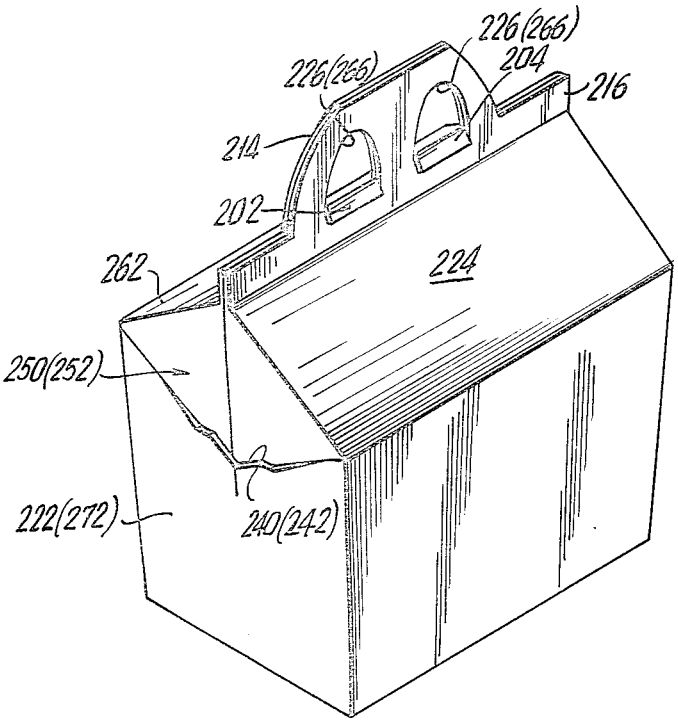
FIG. 11 is a perspective view of the carton, similar to FIG. 1, of the second embodiment of the subject invention.

A second embodiment of the subject invention is illustrated in FIGS. 10 and 11. In this embodiment, handle 214 is additionally provided with tabs 202 and 204, which are hingedly connected along the base of apertures 266. Additionally, the apertures 226 of handle 216 are slightly enlarged near their base. As illustrated in FIG. 11, after wedged shaped tabs 250 (252) are inserted into side panels 222 (272), tabs 202, 204 are folded through apertures 226 and into abutting relation with handle 216. By enlarging apertures 226, the insertion of the tabs 202, 204 therethrough is facilitated. The additional locking arrangement provided by tabs 202, 204 aids in preventing lateral shifting of top panels 262, 224 relative to each other, which insures that apertures 266, 226 remain aligned, while affording greater structural rigidity and a more secure closure of the carton. When it is necessary for this embodiment of the subject carton to be reopened, the tabs 202, 204 are simply unfolded into an upright position whereupon the wedged shaped tabs 250 (252) are manually popped out of the triangular openings 240 (242) and the carton is opened as in the first embodiment.

Accordingly, there is provided a new and improved lunch box carton and blank for forming same for carrying items such as food or toys. The carton can be shipped from the manufacturer in a flattened configuration, thereby saving shipping costs, and can be readily erected and stacked until needed. The carton can be easily closed and reopened employing the new and improved locking means described above. The subject invention further provides a top portion which is attractively gabled in configuration, provides additional interior volume, and includes integral carrying handles.

The present invention has been described in the above specification with reference to a specific embodiment, and such reference has been made for purely illustrative purposes and various modifications in the details included therein may be made without departing from the scope or spirit of the invention as will be obvious to those skilled in the art.

What is claimed is:

1. A lunch box carton of generally inverted truncated pyramidal configuration having a recloseable gabled top portion comprising:

a generally rectangular, tubular sidewall including alternatively hingedly connected side panels and locking side panels, each of said side panels and said locking panels being tapered from the top edge to the bottom edge thereof, each said locking side panel including a generally triangular cut-out portion disposed at the upper edge thereof;

a bottom panel hingedly connected to said sidewall;

two top panels, each respectively hingedly connected along a bottom edge thereof to the top edge of a side panel;

a handle hingedly connected to the top edge of each top panel; and two locking top panels, each being formed from three hingedly connected triangular sections, said sections including a base triangle and two opposed equilateral support triangles, with the bottom edge of each said base triangle being respectively hingedly connected to the top edge of a locking side panel, and with a side edge of each said support triangle being respectively hingedly connected to the side edges of said top panels, and with an apex of each said triangular section being disposed at a common point at the top center of said locking top panel, said common point being disposed below an imaginary line connecting the uppermost corners of said support triangles, with each of said top panels and said locking top panels being tapered from the top edge to the bottom edge thereof such that the open configuration of said carton defines a generally inverted truncated pyramidal configuration to enable stacked nesting of a plurality of cartons whereby, in the closed condition of the carton, the upper edges of said top panels are in abutting relationship forming a gabled configuration, the handles extend above said gabled top portion, and each locking top panel is folded so as to be disposed in coplanar relationship with the associated locking side panel, with the upper end of each said locking top panel extending above the plane defined by the top edges of said side panels, such that said locking top panels function to maintain said top panels in the gabled configuration, and with the lower end of each said locking top panel defining a generally triangular locking tab of greater cross-sectional area than the cross-sectional area of the cut-out portion in the associated locking side panel, with each said triangular locking tab being interengaged with the associated locking side panel by having a portion thereof extending through said cut-out portion internally of said locking side panel for maintaining said gabled top portion in a locked position.

2. A lunch box carton as in claim 1 wherein each said locking side panel includes a generally triangular shaped pivot panel of a configuration substantially conforming to the configuration of said triangular cut-out portion, partially hingedly connected to the top edge of said locking side panel to allow movement of the pivot panel during closure of the carton, said pivot panel being disposed coplanar with the associated locking side panel in the opened carton, and disposed internally of said locking side panel when the carton is in the closed condition.

3. A lunch box carton as in claim 1 wherein the perimeter of each triangular cut-out portion is defined by an irregular line and includes a plurality of angled tabs to aid in locking the carton.

4. A lunch box carton as in claim 1 wherein a nick is provided in each said locking side panel disposed directly below the apex of said generally triangular cut-out, to allow a temporary enlargement of said cut-out to faciliate the closure of the top portion of said carton.

5. A lunch box carton as in claim 1 wherein said bottom panel includes two major bottom panels and two minor bottom panels which are automatically interengaged during erection of said carton forming a closed bottom.

6. A lunch box carton as in claim 1 wherein one said support triangle on each of said locking top panels includes a flattened apex portion which cooperates with the other two triangular sections to provide a three-ply configuration at said common point portion of said triangular locking tab for adding structural rigidity and affording an improved interengagement in the closed carton, thereby more securely locking the carton.

7. A lunch box carton as in claim 1 wherein each said handle includes two openings, said openings in one handle being in register with the corresponding openings in the other handle and defining finger grips for carrying the carton.

8. A lunch box carton as in claim 1 wherein each said handle includes two openings, said openings in one handle being aligned with the corresponding openings in the other handle and defining finger grips for carrying the carton, one handle further including two tabs respectively hingedly connected along the periphery of each said opening, said tabs projecting through said openings in the other handle for engaging said other handle to prevent lateral shifting of said top panels relative to each other.

9. A lunch box carton as in claim 1 wherein said openings in said handles are semi-elliptical in configuration having a curved portion and a base line portion, said tabs of said handle being respectively hingedly connected along the base line portion of each said opening.

10. A blank made of paperboard and adapted to be folded into a lunch box carton of generally inverted truncated pyramidal configuration having a recloseable gabled top portion comprising:

a first locking side panel;

a first minor bottom panel hingedly connected to said first side panel;

a first locking top panel hingedly connected to said first side panel, formed of three hingedly connected generally triangular sections;

a first side panel hingedly connected to said first locking side panel;

a first major bottom panel hingedly connected to said first side panel;

a first top panel hingedly connected to both said first side panel and said first locking top panel;

a first handle hingedly connected to said first top panel;

a second locking side panel hingedly connected to said first side panel and substantially corresponding to the configuration of said first locking side panel;

a second minor bottom panel hingedly connected to said second locking side panel and substantially corresponding to the configuration of said first minor bottom panel;

a second locking top panel hingedly connected to both said second locking side panel and said first top panel, and substantially corresponding to the configuration of said first locking top panel;

a second side panel hingedly connected to said second locking side panel and substantially conforming to the configuration of said first side panel;

a second major bottom panel hingedly connected to said second side panel and substantially corresponding to the configuration of the first major bottom panel;

a second top panel hingedly connected to both said second side panel and said second locking top panel, and substantially corresponding to the configuration of said first top panel;

a second handle hingedly connected to said second top panel and substantially corresponding to the configuration of said first handle;

a first glue tab hingedly connected along the side edge of said second top panel;

a second glue tab hingedly connected along the side edge of said second panel; and each of said side and said top panels being tapered from the top edges to the bottom edges thereof, and with each of said locking side panels including a generally triangular cut-out portion disposed at the upper edge thereof.

11. A blank as in claim 10 wherein each said locking side panel includes a generally triangular shaped pivot panel of a configuration substantially conforming to the configuration of said triangular cut-out and partially hingedly connected to the top edge of said locking side panel.

12. A blank as in claim 10 wherein the perimeter of each generally triangular cut-out portion is defined by an irregular line and includes a plurality of angled tabs.

13. A blank as in claim 10 wherein a nick is provided in each said locking side panel disposed directly below the apex of said generally triangular cut-out.

14. A blank as in claim 10 wherein each said handle includes two openings defining finger grips.

15. A blank as in claim 10 wherein each said handle includes two openings defining finger grips, said first handle further including two tabs respectively hingedly connected along the periphery of each said opening.

16. A blank as in claim 15 wherein said openings in said handle are semi-elliptical in configuration having a curved portion and a base line portion, with said tabs of said first handle being respectively hingedly connected along the base line portion of each said opening.

* * * * *